US007011065B2

(12) United States Patent
Lang

(10) Patent No.: US 7,011,065 B2
(45) Date of Patent: Mar. 14, 2006

(54) AIR INTAKE AND A METHOD FOR INSTALLING AN AIR INTAKE

(75) Inventor: Daniel Lang, Wolverine Lake, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/485,373

(22) PCT Filed: Jul. 31, 2002

(86) PCT No.: PCT/US02/24060

§ 371 (c)(1),
(2), (4) Date: Jan. 30, 2004

(87) PCT Pub. No.: WO03/012279

PCT Pub. Date: Feb. 13, 2003

(65) Prior Publication Data

US 2004/0200449 A1 Oct. 14, 2004

Related U.S. Application Data

(60) Provisional application No. 60/308,561, filed on Jul. 31, 2001.

(51) Int. Cl.
*F02M 35/10* (2006.01)

(52) U.S. Cl. ..... 123/184.24

(58) Field of Classification Search ..... 123/184.24, 123/184.34, 184.42, 184.47
See application file for complete search history.

(56) References Cited

U.S. PATENT DOCUMENTS

| | | | | |
|---|---|---|---|---|
| 4,827,879 | A * | 5/1989 | Ohmi et al. | 123/184.35 |
| 5,144,918 | A | 9/1992 | Tanaka et al. | |
| 5,220,889 | A | 6/1993 | Ampferer et al. | |
| 5,400,750 | A * | 3/1995 | Jaeger et al. | 123/184.47 |
| 5,630,386 | A * | 5/1997 | Uchida | 123/184.34 |
| 5,651,338 | A * | 7/1997 | Pacheco et al. | 123/184.34 |
| 6,098,586 | A * | 8/2000 | Bloomer | 123/184.21 |
| 6,622,682 | B1 * | 9/2003 | Ikuma et al. | 123/184.34 |
| 6,802,293 | B1 * | 10/2004 | Iwata et al. | 123/184.42 |

* cited by examiner

*Primary Examiner*—Marguerite McMahon
(74) *Attorney, Agent, or Firm*—Crowell & Moring LLP

(57) ABSTRACT

The invention relates to an air intake for an engine (19) of a motor vehicle. In particular, the present invention concerns a detachable connection between an air collector module (10) and an intake duct module (11) of the air intake. The invention also concerns a method for installing the air intake to the engine (19) of the motor vehicle. A preferred embodiment of the air intake comprises a detachable connection comprising at least one releasable connection arrangement (17) and at least one interlock arrangement (18). The at least one releasable connection arrangement (17) comprises a releasable connector (25) inserted through the air collector module (10) and arranged to secure the air collector module (10) to the intake duct module (11). The at least one interlock arrangement (18) comprises a bracket (31) mounted on one of the air collector module (10) and the intake duct module (11), and an opposing piece (32) mounted on the other of the air collector module (10) and the intake duct module (11).

23 Claims, 5 Drawing Sheets

AIR INTAKE AND A METHOD FOR INSTALLING AN AIR INTAKE

This application claims the benefit of Provisional Application No. 60/308,561, filed Jul. 31, 2001.

BACKGROUND OF THE INVENTION

The invention relates to an air intake for an engine of a motor vehicle. In particular, the present invention concerns a detachable connection between an air collector module and an intake duct module of the air intake. The invention also concerns a method for installing the air intake to the engine of the motor vehicle.

A known intake device is disclosed in European Patent No. 0 467 408 (corresponding to U.S. Pat. No. 5,144,918). This intake device includes an intake channel module and a collector module. The intake channel module consists of several intake ports, whereby the intake ports are connected on one side to an internal combustion engine and on the other side to the collector module. The connection between the collector module and the intake port module has a circular connecting surface which can be implemented either with a threaded connection or with a fixed connection. The intake port module must be made from a high-quality temperature-resistant material since the material is exposed to elevated temperatures in the area where the intake port module connects to the internal combustion engine.

Due to the circular shape of the connecting surf ace and the accessibility of the screws at the connecting surface, in order for a detachable connection of the intake device to be achieved, the intake port module must first be connected to the collector module before fastening it to the internal combustion engine. However, if the engine compartment is cramped, the intake device can only be fastened to the internal combustion engine under difficult conditions and/or cannot be connected at all. Moreover, the collector module and the intake port module are made from the same materials which causes greater expense.

SUMMARY OF THE INVENTION

The object of the invention is to avoid at least the above-identified disadvantages of the prior art and thereby provide an air intake which is cost-effective and easily installed. This is achieved by way of the air intake of the present invention which comprises an air collector module and an intake duct module. A preferred embodiment of the air intake comprises a detachable connection comprising at least one releasable connection arrangement and at least one interlock arrangement. The at least one releasable connection arrangement comprises a releasable connector inserted through the air collector module and arranged to secure the air collector module to the intake duct module. The at least one interlock arrangement comprises a bracket mounted on one of the air collector module and the intake duct module, and an opposing piece mounted on the other of the air collector module and the intake duct module and in secure contact with the bracket.

As a result of the present invention, the air collector module can be connected to the intake duct module with a detachable connection which is cost-effective and easily installed in an engine compartment.

Since the material of the intake duct module is stronger than the material of the air collector module, the air collector module is provided with a strength increasing member which operates to substantially prevent the releasable connector from deforming the air collector module. In a preferred embodiment, the strength increasing member is a sleeve. By incorporating such a strength increasing member, which is preferably metallic, the air collector module will not undergo deformation, even under a maximum tightening force of the releasable connector, since any deformations will be overcome by the strength increasing member.

According to an advantageous further embodiment of the invention, the strength-increasing means is a bearing bushing which is arranged in a holding bracket of the air collector module. The bearing bushing is fitted into the air collector module which can be made from a material having a lower strength compared to the bearing bushing. It is also possible to coat the bearing by way of an injection coating procedure. The bearing bushing penetrates the air collector module in an area of the detachable connection such that a distribution of connecting forces occurs. In further advantageous embodiments, the bearing bushing penetrates completely into the air collector module and the intake duct module, whereby the bearing bushing has a contact surface with both of these components. A fastening means, for example, a screw or bolt, is passed through the bearing bushing for detachably connecting the air collector module and the intake duct module.

In a further preferred embodiment of the invention, the structure for increasing the strength comprises a material which has a higher strength than the material of the air collector module, and a lower strength than the material of the intake duct module. As an example, a structure for increasing the strength having such material characteristics can be an insert which is installed in a holder of the air collector module. The insert is interconnected with a bracket of the intake duct module such that connecting forces that occur in the detachable connection are conducted at least partially directly to the intake duct module which possesses the higher strength material. This prevents the material of the air collector module from beginning to yield in the area of the detachable connection, which could loosen the detachable connection.

In addition, the structure for increasing the strength can be, for example, a washer which contacts the air collector module and operates to provide a better distribution of force when tightening the detachable connection. Alternatively, the structure for increasing the strength is an area of the air collector module which has been subjected to a heat treated hardening process.

In the embodiment of the present invention incorporating the sleeve as the strength increasing member, the sleeve can be arranged to have at least two contact surfaces which are supported on the air collector module which is made from a material which is weaker than the material of the air collector module. In order to form these contact surfaces, the sleeve is shaped to (i) have rotational symmetry, (ii) be supported on one side by a releasable connector resting on the air collector module, and (iii) have a chamfered reduced shoulder. The reduction in dimension of the shoulder is necessary if the sleeve is to be pressed into the first component. For injection-coated sleeves, the shoulder can also be partially enlarged in its dimensions and reduced again at a defined distance. In this way, the sleeve cannot be accidentally removed from the air collector module during disassembly.

According to a further embodiment of the present invention, the air collector module and the intake duct module are connected to one another with a hinge-type connection. In this embodiment, two connecting devices are combined for achieving an optimum connection. The combination of the two connecting devices provides a very reliable connection while being simple to install. In particular, the hinge can be located to provide the most favorable installation. The air collector module is mounted on an intake duct module so that the air connector module can be swung out of the installation area during the installation of the intake duct module on the internal combustion engine. As a result, the fastening of the intake duct module on the internal combustion engine is simplified because of better accessibility. When the intake duct module is fastened on the internal combustion engine, the air collector module can then be fastened onto the intake duct module. The fastening of the air collector module to the intake duct module can be designed in such a way that the screws are arranged so that they are distributed uniformly in the connecting area. This results in stress relief for the hinge, which serves to simplify installation and position the air collector module on the intake duct module.

It is advantageous if the detachable connection mechanism is formed both by the interlock arrangement having the opposing piece and by the threaded connection mechanism having a strength increasing member, whereby the strength increasing member is mounted on a side opposite from the interlock arrangement. In this design, the interlock arrangement and the opposing piece, which can also be designed as a hinge, allow connecting forces to be absorbed. As a result of this design, during installation, only a partial area of the connection needs to be accessible, which is advantageous for narrow and partially obscured installation spaces.

Another embodiment of the present invention provides that a gasket is installed to achieve an adequate seal between the air collector module and the intake duct module, whereby the gasket is fixed on one of the two components. As a result of this design, the gasket cannot slip out during installation and cause leakage. For example, the gasket can be glued to fasten it to one of the components. In addition, the gasket can be at least partially installed in a recess provided on one of the components.

The method for installing an intake device according to the present invention can be divided into three important assembly steps. In the first assembly step, a strength-increasing structure is placed in the air collector module which is made from a material having a lower strength. In the second assembly step, the intake duct module is connected to the internal combustion engine. In the third assembly step, the air collector module is connected to the intake duct module.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
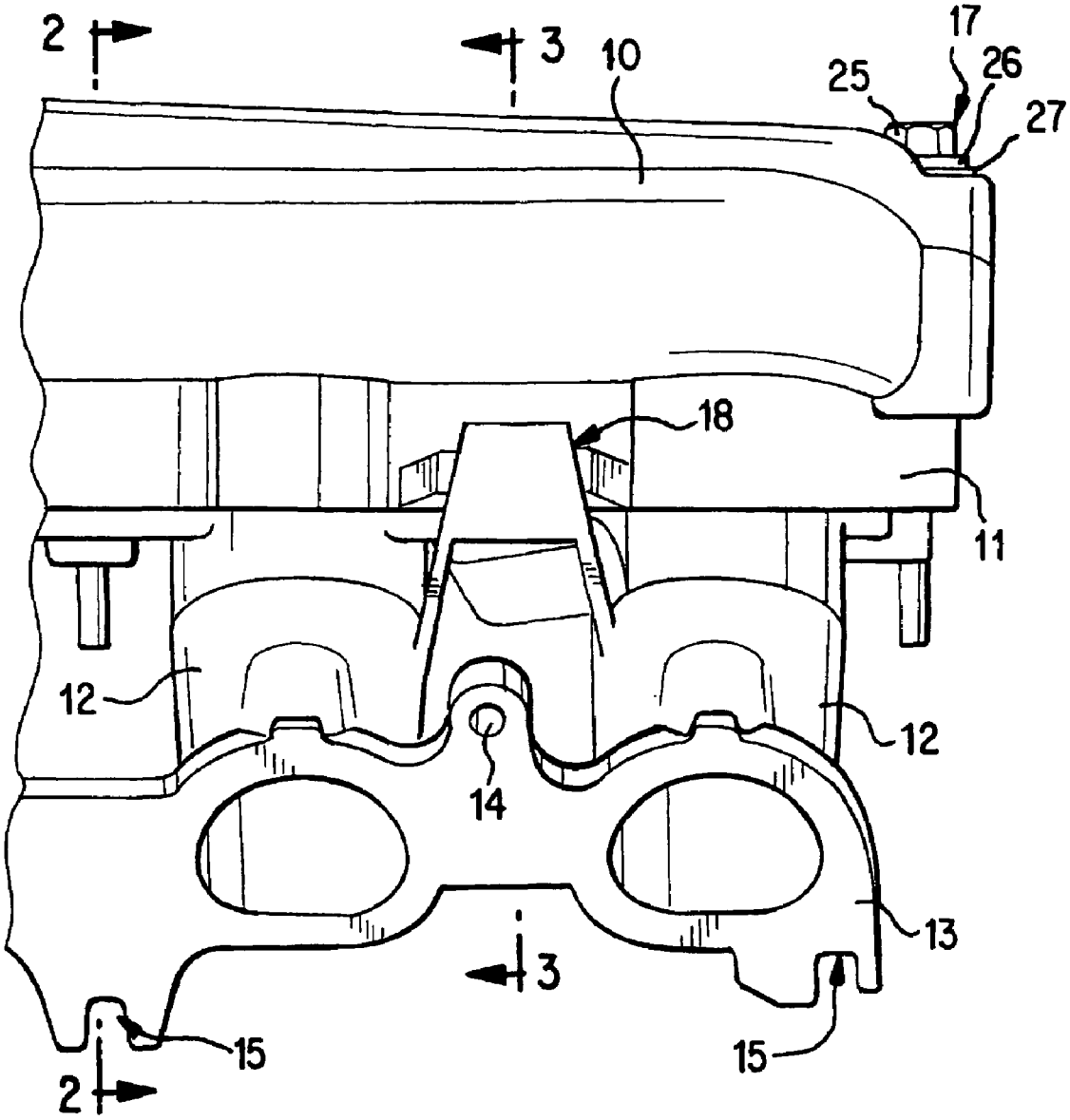
FIG. 1 shows a front view of an air intake incorporating a first preferred embodiment of the present invention.
Figure 2:
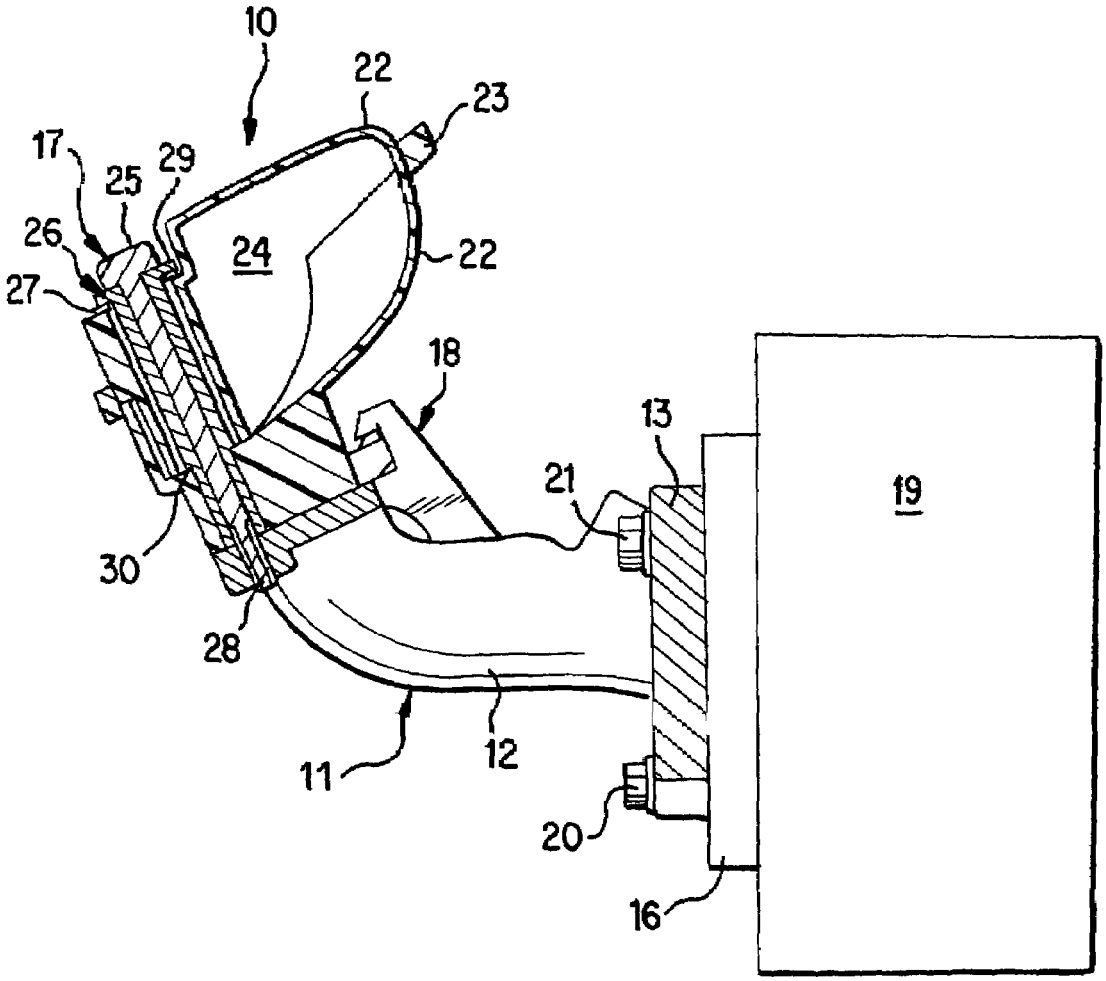
FIG. 2 shows a cross-section of the air intake taken along line A—A of FIG. 1.

FIG. 1 illustrates a front view of an air intake incorporating a first preferred embodiment of the present invention. The air intake includes an air collector module 10 and an intake duct module 11. Intake duct module 11 has several intake ducts 12 mounted in parallel to each other and a cylinder head flange 13. Fastening holes 14 and recesses 15 are arranged in the area of the cylinder head flange 13 and are used to fasten the intake duct module 12 to a cylinder head 16 (as shown in FIG. 2). The intake duct module 11 is detachably connected to the air collector module 11 through a connection mechanism. The connection mechanism comprises both releasable connections 17 and at least two interlock arrangements 18, each of these connections 17, 18 being mounted on opposite sides of the air collector module 10. Connections 17, 18 will be described in more detail in conjunction with FIGS. 2 and 3.

FIG. 2 shows a cross-section of the first preferred embodiment of the air intake taken along line A—A of FIG. 1. Line A—A runs through the threaded connection 17. Similar components shown in FIG. 1 are provided with identical reference numbers in FIG. 2. In FIG. 2, the air intake is connected to the cylinder head 16 of an internal combustion engine 19. A connection between the cylinder head 16 and the cylinder head flange 13 is implemented by a head bolt 20 that is connected tightly to the cylinder head 16 and is hooked into a recess 15 as shown in FIG. 1. In order that the intake duct module 11, which consists of cast aluminum, does not loosen from the cylinder head 16, hex screws 21 are inserted through the fastening holes 14 and screwed together with the cylinder head 16.

The air collector module 10 comprises two half-shells 22 that are welded together in a sealed fashioned. The sealed half-shells 22 are made from a plastic, e.g. polyamide. In an area of contact between the half-shells 22, a circumference bead 23 is arranged. The two half-shells 22 surround a collector chamber 24 from which air reaches the individual intake ducts 12.

At least one releasable connection 17 is provided for fastening the air collector module 10 to the intake duct module 11. Each releasable connection 17 includes a releasable connector, such as a screw 25 or a clip. In an alternative embodiment, the screw 25 is surrounded by a sleeve 26 which operates as a strength increasing member to increase the strength of the air collector module 10. It is especially advantageous to implement a strength increasing member when the air collector module 10 is made from a material which is not as strong as the material of the intake duct module 11. For example, when the air collector module 10 is made from a plastic and the intake duct module 11 is made from a metal. The sleeve 26 can be arranged to be in contact with a washer 27. The screw 25 penetrates the sleeve 26, whereby it is screwed with its thread 28 extending out of sleeve 26 into the intake duct module 11. In order to achieve optimum force distribution in the air collector module 10, the sleeve 26 comprises a collar 29 and a shoulder 30, and is made from metal. The collar 29 is supported on washer 27, which lies on the upper half-shell 22. The shoulder 30 rests on the lower half-shell 22 and thus conducts part of the connecting forces into the lower half-shell 22. The end of the sleeve 26 rests directly on the intake duct module 11. In this way, even with a maximum tightening force, the screw 25 can only deform the sleeve 26 without deforming the air collector module 10. Since plastic begins to yield with continuous pressure, the connection would loosen over time and become unsealed if the sleeve were to be made from plastic.

In alternative embodiments of the air intake of the present invention, the strength increasing member is an area of the air collector module 10 which has been subjected to a heat treated hardening process. This hardened area of the air collector module 10 operates to reduce deformations of the air collector module 10 due to the tightening force exerted by the releasable connector, i.e. screw 25. In further preferred embodiments, the strength increasing member is a washer which contacts the air collector module 10 and operates to distribute the tightening force exerted by the releasable connector on the air collector module 10.

Figure 3:
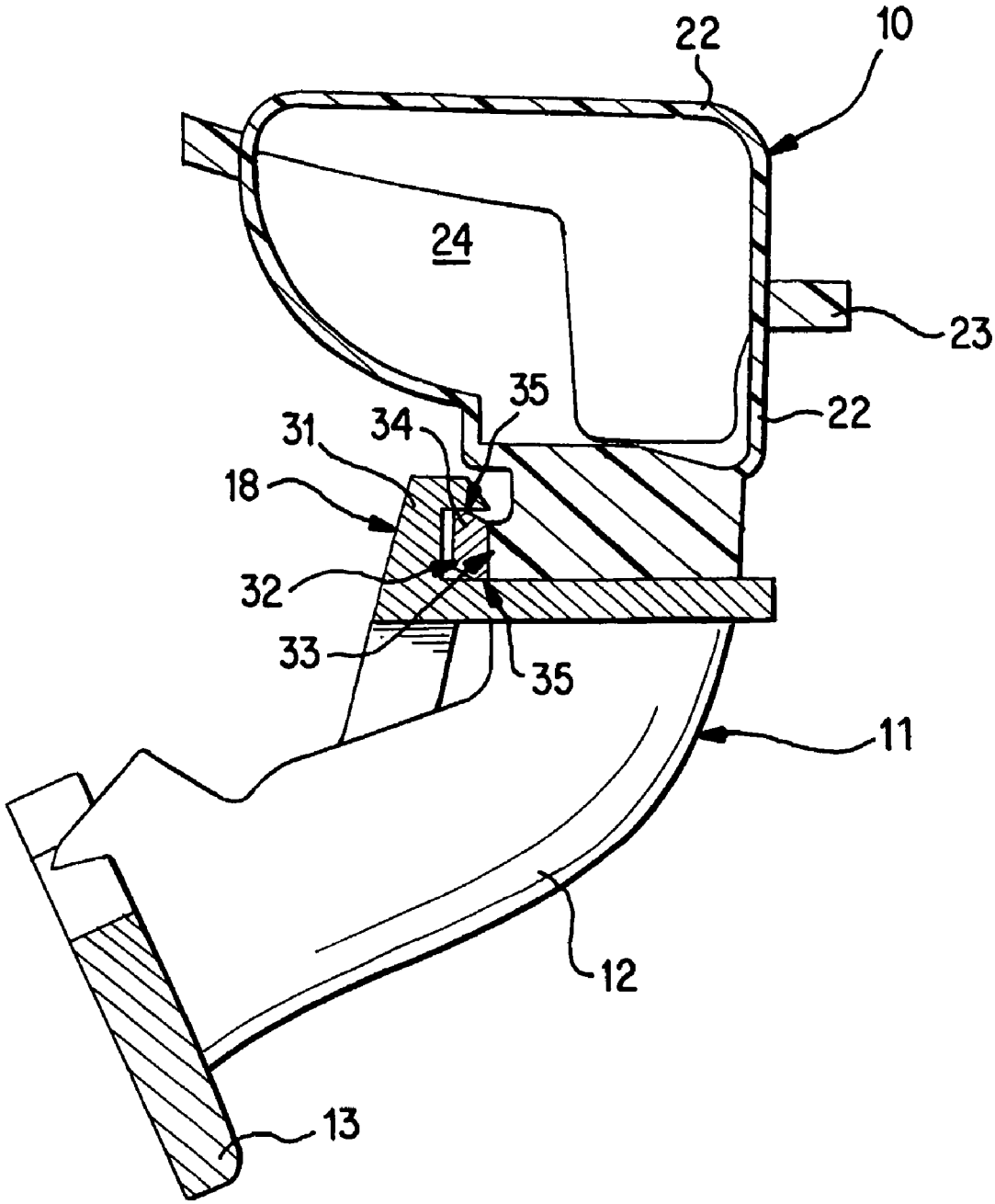
FIG. 3 shows a cross-section of the air intake taken along line B—B of FIG. 1.

FIG. 3 shows a cross-section of the first preferred embodiment of the air intake taken along line B—B of FIG. 1. Similar components shown in FIGS. 1 and 2 are provided with identical reference numbers in FIG. 3. This cross-section illustrates an interlock arrangement 18, which is formed on one side by a bracket 31 mounted on the intake duct module 11 and on the other side by an opposing piece 32 mounted on the air collector module 10. Alternatively, it is contemplated that the bracket 31 could be mounted on the air collector module 10, and the opposing piece 32 could be mounted on the intake duct module 11. The opposing piece 32 is formed by an insert 34 placed in an insert holder 33. The insert 34 is pressed into the insert holder 33 such that it cannot fall out during assembly. In a preferred embodiment, the insert 34 is made from a metal that is somewhat softer than the intake duct module 11 but is harder than the air collector module 10. The insert 34 has two opposing contact surfaces 35, which contact the bracket 31.

Figure 4:
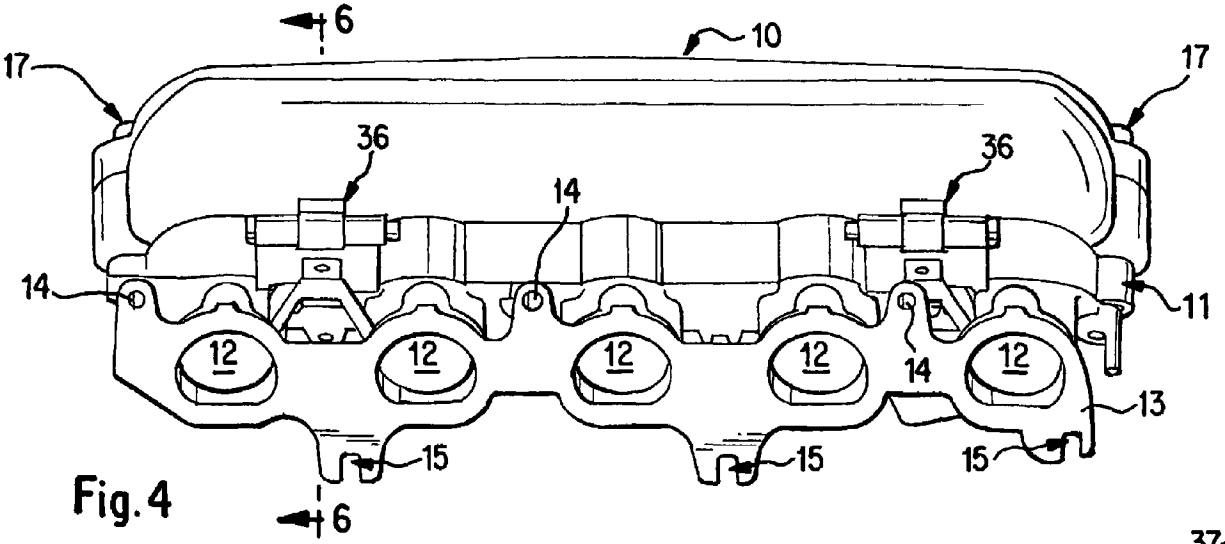
FIG. 4 shows a front view of an air intake incorporating a second preferred embodiment of the present invention.

FIG. 4 shows a front view of a second preferred embodiment of the air intake of the present invention. Similar components shown in FIG. 1 are provided with identical reference numbers in FIG. 4. This air intake has five intake ducts 12 that are mounted in parallel to each other. Threaded connections 17 and two hinge connections 36 are provided for connecting the air collector module 10 to the intake duct module 11. The hinge connections 36 are shown in more detail in FIGS. 6 and 7 as discussed below.

Figure 5:
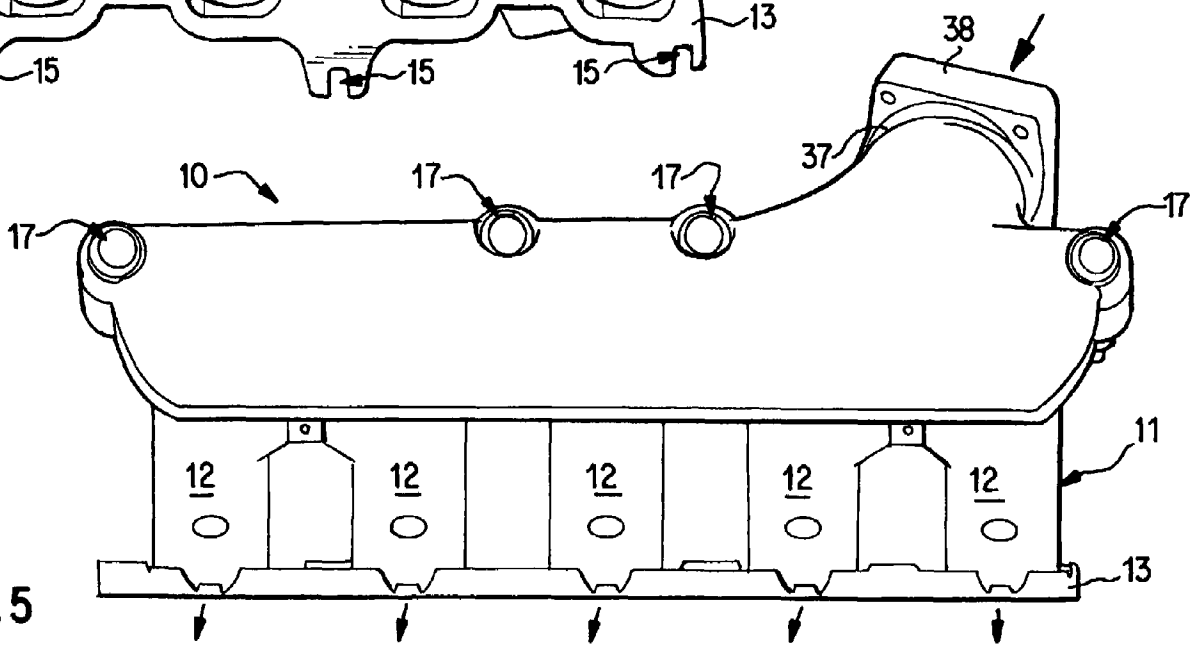
FIG. 5 shows a top view of the air intake of FIG. 4.

FIG. 5 shows a top view of the air intake of FIG. 4. Similar components shown in FIG. 4 are provided with identical reference numbers in FIG. 5. The air collector module 10 has an air inlet pipe 37 through which air can enter into the collector chamber 24. A flange 38 is mounted on the air inlet pipe 37 through which the air collector module 10 can be connected to adjacent air-carrying lines. The air contained in collector chamber 24 is then guided through the intake ducts 12 of the internal combustion engine 19.

Figure 6:
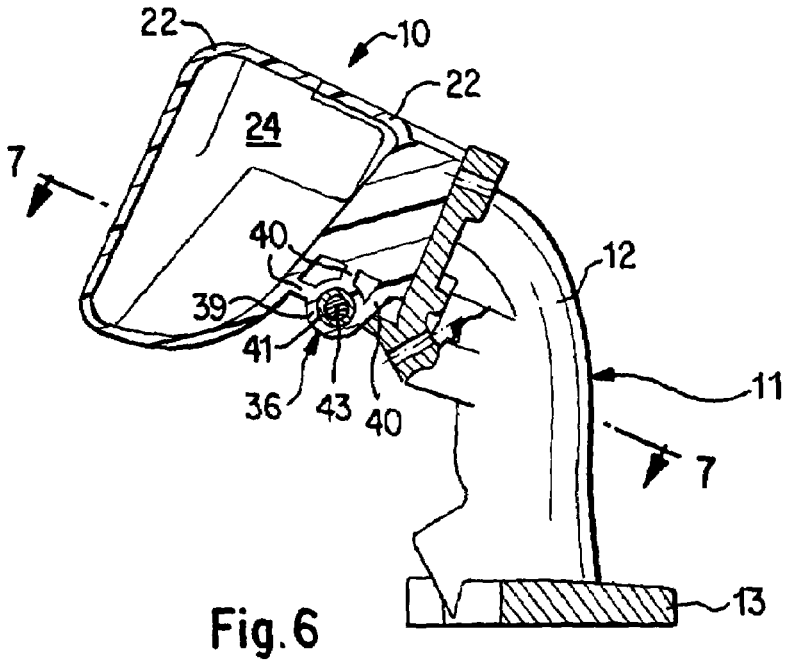
FIG. 6 shows a cross-section of the second preferred embodiment of the air intake taken along line C—C of FIG. 4.
Figure 7:
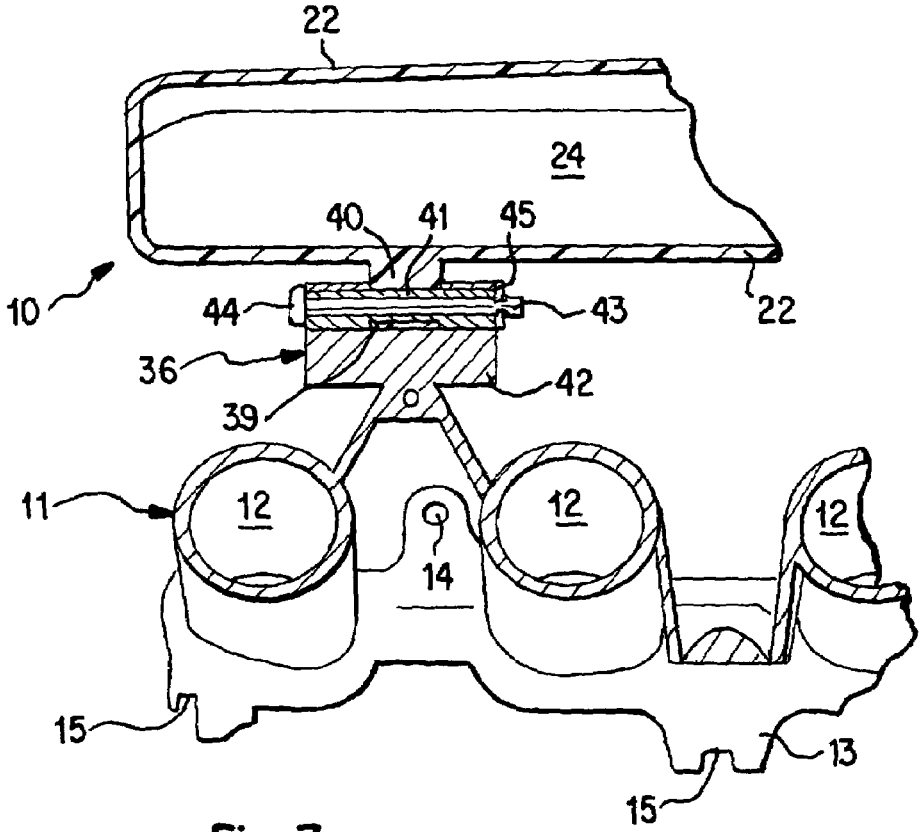
FIG. 7 shows a cross-section of the second preferred embodiment of the air intake taken along line D—D of FIG. 6.

FIG. 6 shows a cross-section of the second preferred embodiment of the air intake taken along line C—C of FIG. 4. Similar components shown in FIG. 3 are provided with identical reference numbers in FIG. 6. The hinge connection 36 is formed on one side by the air collector module 10 and on the other side by the intake duct module 11. A first holding bracket 39 having three ribs 40 is formed on the air collector module 10 and a bearing bushing 41 made of metal is pressed into the first holding bracket 39. A second holding bracket 42, as shown in FIG. 7, is formed on the intake duct module 11. A bolt 43 is passed through the second holding bracket 42 and the bearing bushing 41. The bolt 43 operates to connect the air collector module 10 to the intake duct module 11.

FIG. 7 shows a cross-section of the second preferred embodiment of the connection mechanism taken along line D—D of FIG. 6. Similar components shown in FIG. 6 are provided with identical reference numbers in FIG. 7. As shown in FIG. 7, the second holding bracket 42 is designed to have two extending bolt supporting portions, such that a single bolt supporting portion of the first holding bracket 39 is arranged between two sides of the bolt supporting portions of the second holding bracket 42. The bolt 43 penetrates through these portions of the holding brackets 39, 42 such that a head 44 contacts one side of a bolt supporting portion of the second holding bracket 42. The side of bolt 43 opposite the head 44 is secured against loosening with any type of removable securing mechanism, such as a circlip 45. The hinge connection 36 can be joined and/or separated whenever desired. However, normally a single installation procedure is performed.

A method for installing an air intake according to the invention can be divided into three assembly steps. In the first assembly step, the sleeve 26 or any strength-increasing structure is formed or inserted into the air collector module 10. As previously discussed, the sleeve 26 or strength-increasing structure is made from a material having a higher strength relative to the air collector module 10. In the second assembly step, the intake duct module 11 is connected to the internal combustion engine 19. In the third assembly step, the air collector module 10 is connected to the intake duct module 11.

Regarding the first assembly step, different methods can be used to install the strength-increasing structure 26 into the first component 10. One option includes pressing the strength-increasing structure 26 into the air collector module 10. In this method, the air collector module 10 comprises a material made with a relatively low strength, e.g., a thermoplastic like PA or PP. Since the strength-increasing structure 26 is made from a material having a greater strength, the material of the air collector module 10 is somewhat deformed when the strength-increasing structure 26 is pressed therein. Due to the press-fit, the strength-increasing structure 26 is fixed in the air collector module 10 and cannot fall out during at least installation or removal.

Another possibility for the installation of the strength-increasing structure 26 into the first component 10 comprises surrounding the strength-increasing structure 26 with material during the formation of the air collector module 10. If, for example, the air collector module 10 is made from a thermoplastic, the strength-increasing structure 26 can be placed in the injection molding machine and then be injection-coated with plastic. In this process, the strength-increasing structure 26 can be provided with cutouts into which the material flows during the formation of the air collector module 10. After hardening, the material produces a form-fit connection.

During the second assembly step, the intake duct module 11 is fastened to the internal combustion engine 19, whereby the air collector module 10 is not yet fastened to the intake duct module 11. If space for the installation is limited, the intake duct module 11 is screwed onto the cylinder head 16 of the internal combustion engine 19 with a cylinder head flange 13. Since the air collector module 10 has not yet been connected to the intake duct module 11, the air collector module 10 does not interfere with the installation of the intake duct module 11. In this manner, an installer has easier access to the cylinder head flange 13 during the fastening of the intake duct module 11 to the cylinder head 16.

During the third assembly step, the air collector module 10 is connected to the intake duct module 11. Since the intake duct module 11 is already fastened to the cylinder head 16, the installer does not have to be concerned with this connecting point, which at this time in the installation process is often times inaccessible. As a result of the method of the present invention, the inaccessibility of this connection point does not have a negative influence on the function of the device or its assembly since the intake duct module 11 generally has a long service life and therefore, is only attached to the internal combustion engine 19 once, and remains connected to the internal combustion engine 19 for its entire service life. If for some reason the intake duct module 11 has to be replaced, the air collector module 10 can be removed from the intake duct module 11 using the detachable connection mechanism of the present invention, whereby the connection between the cylinder head 16 and the intake duct module 11 becomes accessible again.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An air intake comprising:

an air collector module;

an intake duct module connected to the air collector module by way of a detachable connection;

the detachable connection comprising at least one releasable connection arrangement and at least one interlock arrangement;

wherein the at least one releasable connection arrangement comprises;

a releasable connector inserted through the air collector module and arranged to secure the air collector module to the intake duct module;

wherein the at least one interlock arrangement comprises;

a bracket mounted on one of the air collector module and the intake duct module; and an opposing piece mounted on the other of the air collector module and the intake duct module and in secure contact with the bracket.

2. The air intake according to claim 1, wherein the air collector module is made from a plastic.

3. The air intake according to claim 2, wherein the releasable connector secures the air collector module to the intake duct module by way of a strength increasing member which substantially prevents the releasable connector from deforming the air collector module.

4. The air intake according to claim 3, wherein the strength increasing member is a sleeve inserted into the air collector module and through which the releasable connector is inserted.

5. The air intake according to claim 4, wherein the sleeve is press-fit into the air collector module and an end portion of the sleeve contacts the intake duct module to direct connecting forces at least partially directly to the intake duct module.

6. The air intake according to claim 4, wherein the sleeve comprises two contact surfaces which contact the air collector module.

7. The air intake according to claim 6, wherein the two contact surfaces of the sleeve comprise (i) a collar and (ii) a shoulder.

8. The air intake according to claim 3, wherein the strength increasing member is an area of the air collector module which has been subjected to a heat treated hardening process.

9. The air intake according to claim 3, wherein the strength increasing member is a washer in contact with the air collector module which distributes connecting forces of the releasable connector to the air collector module.

10. The air intake according to claim 4, wherein the sleeve is made from metal.

11. The air intake according to claim 2, wherein the air collector module is made from a thermoplastic.

12. The air intake according to claim 11, wherein the air collector module is made from polyamide.

13. The air intake according to claim 1, wherein the opposing piece of the at least one interlock arrangement is an insert securely arranged in an insert holder of the other of the air collector module and the intake duct module.

14. The air intake according to claim 13, wherein the insert is made from a metal which is softer than a material of the other of the air collector module and the intake duct module and harder than a material of the one of the air collector module and the intake duct module.

15. The air intake according to claim 14, wherein the insert comprises two opposing contact surfaces which contact the bracket.

16. The air intake according to claim 1, wherein the intake duct module comprises a cylinder head flange.

17. The air intake according to claim 1, wherein the air collector module and the intake duct module are each made from a different material.

18. The air intake according to claim 17, wherein the material of the intake module can withstand a higher temperature than the material of the air collector module.

19. The air intake according to claim 1, wherein the intake duct module is made from metal.

20. The air intake according to claim 19, wherein the intake duct module is made from cast aluminum.

21. The air intake according to claim 4, wherein the releasable connection is a screw.

22. The air intake according to claim 4, wherein the releasable connection is a clip.

23. The air intake according to claim 1, wherein a gasket is arranged between the air collector module and the intake duct module.

* * * * *